US006231390B1

(12) United States Patent
Chang

(10) Patent No.: US 6,231,390 B1
(45) Date of Patent: May 15, 2001

(54) CONNECTOR FOR USE IN PORTABLE PHONE

(75) Inventor: Yao-Hao Chang, Chung-Ho (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/461,518

(22) Filed: Dec. 14, 1999

(30) Foreign Application Priority Data

Oct. 21, 1999 (TW) ..... 088217919

(51) Int. Cl.[7] ..... H01R 13/648
(52) U.S. Cl. ..... 439/607
(58) Field of Search ..... 439/607

(56) References Cited

U.S. PATENT DOCUMENTS 4,938,704 * 7/1990 Fujiura ..... 439/607 X
5,685,739 * 11/1997 Davis et al. ..... 439/607
5,800,207 * 9/1998 Hsu et al. ..... 439/607 X
5,980,320 * 11/1999 Slack et al. ..... 439/607

* cited by examiner

*Primary Examiner*—Renee Luebke
(74) *Attorney, Agent, or Firm*—Wei Te Chung

(57) ABSTRACT

An electrical connector of the present invention for use in a portable phone comprises an elongate insulative housing (1), a plurality of contacts (2) and a shield (3). The housing includes a first receptacle portion (11), a second receptacle portion (12), a barrier (13) separating the first receptacle portion from the second receptacle portion, and a pair of arms (14). Each receptacle portion defines a plurality of contact receiving passageways (101) therethrough for receiving contacts. The first and second receptacle portions can optionally connect with a single plug or with two plugs (one signal plug, one DC power recharging plug) at the same time.

5 Claims, 9 Drawing Sheets

CONNECTOR FOR USE IN PORTABLE PHONE

FIELD OF THE INVENTION

The present invention relates to a connector, and particularly to a composite connector used in a portable phone for connection with mating connectors for transmitting signals and for connecting to a DC power recharger.

DESCRIPTION OF THE PRIOR ART

As the communication industry develops, the functions and use of portable phones is being improved day by day. Accordingly, the trend in connectors used in portable phones is to integrate many functions in one connector. U.S. Pat. No. 5,812,660 discloses a prior art connector as shown in FIG. 9. This prior art connector comprises an insulative housing 6 having a rectangular connection recess 611 extending rearward from a front surface 61. A flat connector 612 and a pair of RF terminals 613 are arranged within the connection recess 611. The flat connector 612 includes an insulation plate 6121 and signal terminals 7 on upper and lower surfaces of the insulation plate 6121. The RF terminals 613 are disposed on opposite sides of the flat connector. A pair of metallic reinforcing members 614 is provided on opposite sides of the connection recess 611, not only to reinforce the thin upper wall of the connection recess 611, but also to serve as power terminals for recharging the portable phone, by means of a charger. The connector is also provided with a DC jack 615, which is accessible from the front surface 61. Battery terminals 8 project diagonally upwardly from the upper left sidewall of the housing 6 for contacting a battery within the portable phone. An integrated mating connector is required to mate with the plate connector 612 and the RF terminals 613, and it is impossible to use two small size, optional use connectors with this prior art connector. In addition, when the battery is being charged the flat connector and the RF terminals 613 can not be used at the same time, which does not facilitate the consumer's use of the portable phone. Hence, an improved electrical connector is required to overcome the disadvantages of the prior art.

SUMMARY OF THE INVENTION

An object of the present invention is to provide a connector for a portable phone which is thin and which can support many functions.

A second object of the present invention is to provide a connector for a portable phone which can be alternately or simultaneously connected with mating plug connectors connected to a signal transmitting cable and to a DC power recharger cable.

A connector in accordance with the present invention comprises an insulative housing, a plurality of contacts and a shield. The housing includes a first receptacle portion, a second receptacle portion and a barrier separating the first receptacle portion from the second receptacle portion. Each receptacle portion defines a plurality of contact receiving passageways therethrough. A pair of positioning slots is defined beside each receptacle portion. Each contact includes an engaging section, a transition section and a solder tail. The shield encloses the housing and has a locking aperture on a top plate thereof above each positioning slot for locking a mating plug connector in secure connection with a corresponding receptacle portion.

Other objects, advantages and novel feature of the invention will become more apparent from the following detailed description of the present embodiment when taken in conjunction with the accompanying drawings.

DETAILED DESCRIPTION OF THE INVENTION

Figure 1:
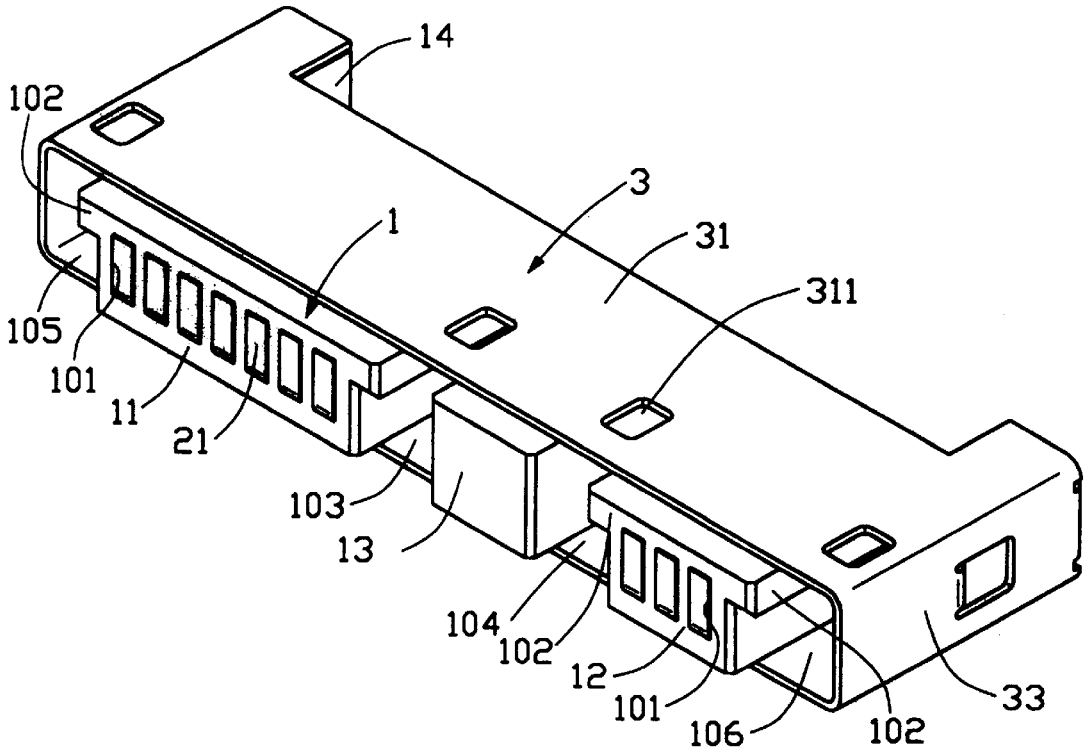
FIG. 1 is a perspective view of an electrical connector in accordance with the present invention.
Figure 2:
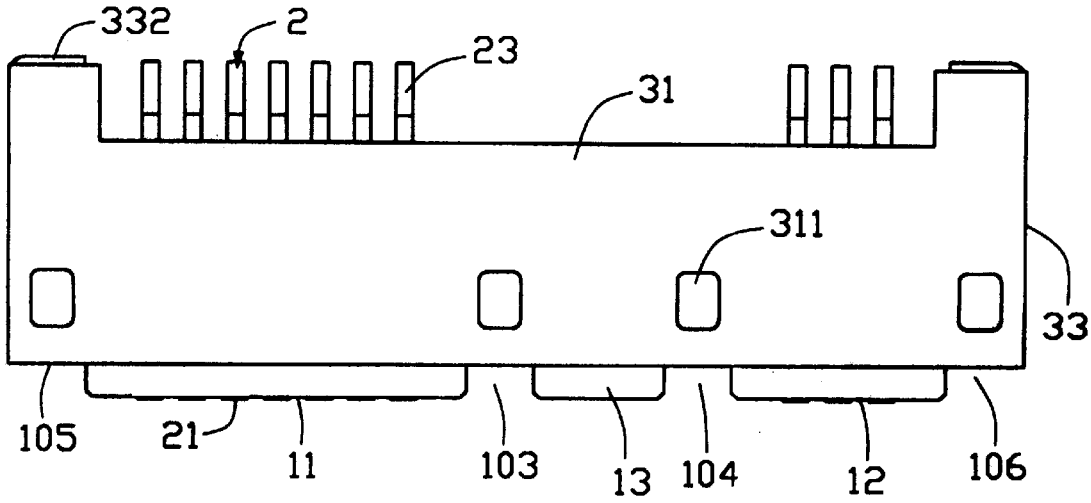
FIG. 2 is a top view of the electrical connector of FIG. 1.
Figure 3:
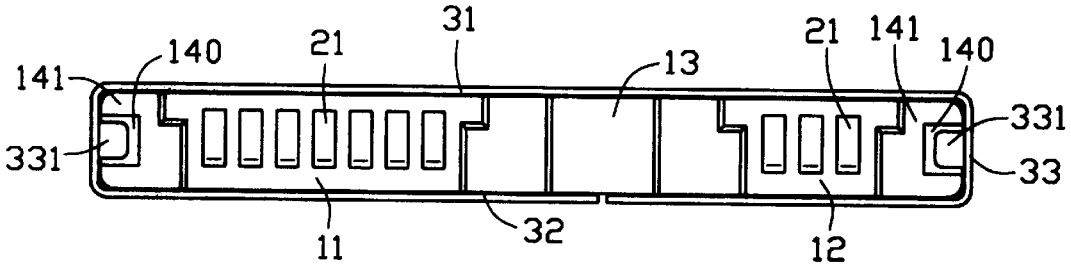
FIG. 3 is a front view of the electrical connector of FIG. 1.
Figure 4:
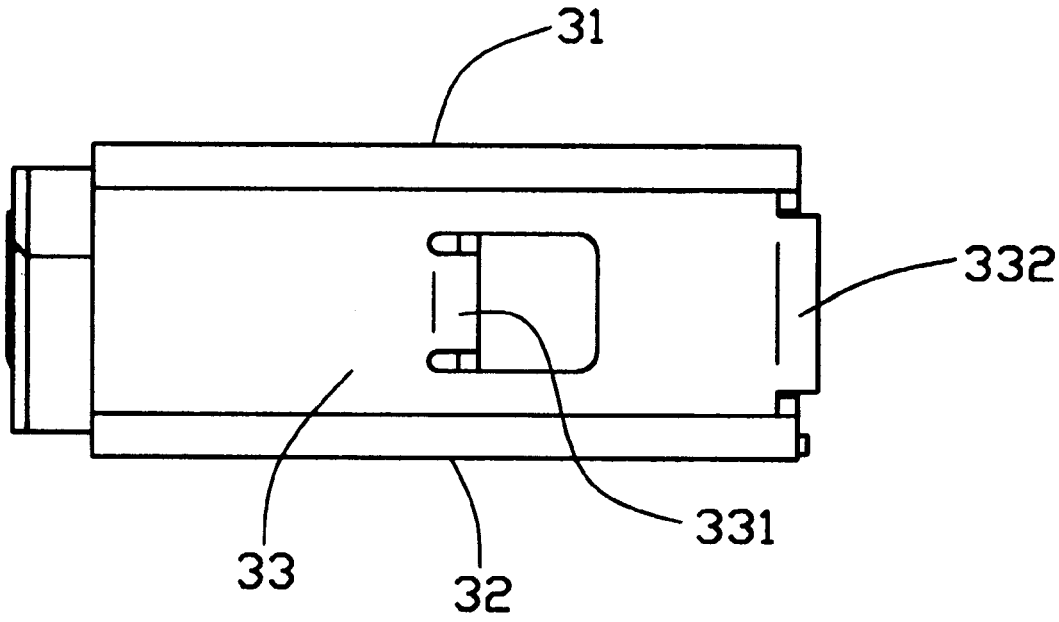
FIG. 4 is a side view of the electrical connector of FIG. 1.
Figure 5:
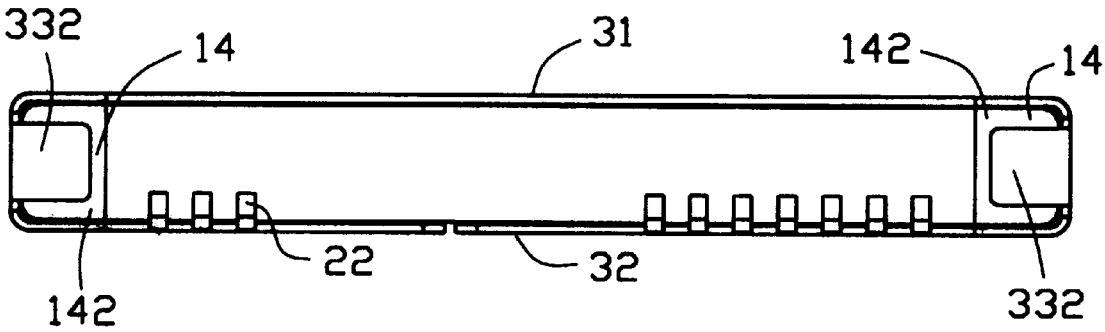
FIG. 5 is a rear view of the electrical connector of FIG. 1.

Referring to FIGS. 1–5, an electrical connector in accordance with the present invention comprises an insulative housing 1, a plurality of contacts 2 and a shield 3. The elongate housing 1 comprises a first receptacle portion 11, a second receptacle portion 12, a rectangular barrier 13 separating the first receptacle portion 11 from the second receptacle portion 12, and a pair of arms 14. Each receptacle portion 11, 12 defines a plurality of contact receiving passageways 101 therethrough for receiving the contacts 2. In the embodiment shown of the present invention, the first receptacle portion 11 receives seven contacts 2 for transmitting signals and the second receptacle portion 12 receives three contacts 2 for connection to a DC power recharger. A flange 102 is formed on an upper portion of each lateral side of each receptacle portion 11, 12 to assure correct insertion of a mating plug connectors 4, 5 (see FIGS. 6–7). Positioning slots 103 and 104 are defined between the barrier 13 and each receptacle portion 11, 12. The housing 1 forms a pair of arms 14 on two opposite sides, each arm 14 having a front face 141 and a rear face 142. A notch 140 is defined in the front face 141 of each arm 14.

Each contact 2 is the same in shape and comprises an engaging section 21 extending at a front surface (not labeled) of an associated receptacle portion 11, 12, a transition section 22 received in the corresponding contact receiving passageway 101, and a solder tail 23 extending out of a rear surface (not labeled) of the associated receptacle portion 11,12 for soldering to a printed circuit board (not shown).

The shield 3 has a shape and size suitable for enclosing the housing 1 and has a top plate 31, a bottom plate 32 and opposite side plates 33. A positioning slot 105 is defined between the first receptacle portion 11 and left side plate 33 of the shield 3 and a positioning slot 106 is defined between the second receptacle portion 12 and right side plate 33 of the shield 3. A locking aperture 311 is defined in the top plate 31 above each positioning slot 103, 104, 105, 106. A locking tab 331 is formed in each side plate 33 for engaging with the notch 140 of a corresponding arm 14. Each side plate 33 has an integral retaining tab 332 at a rearward end thereof. In assembly, the locking tabs 331 snap into the notches 140 and the retaining tabs 332 are inwardly bent and abut against the rear faces 142 of the arms 14 of the housing 1, so that the housing 1 is fixedly retained in the shield 3.

Figure 6:
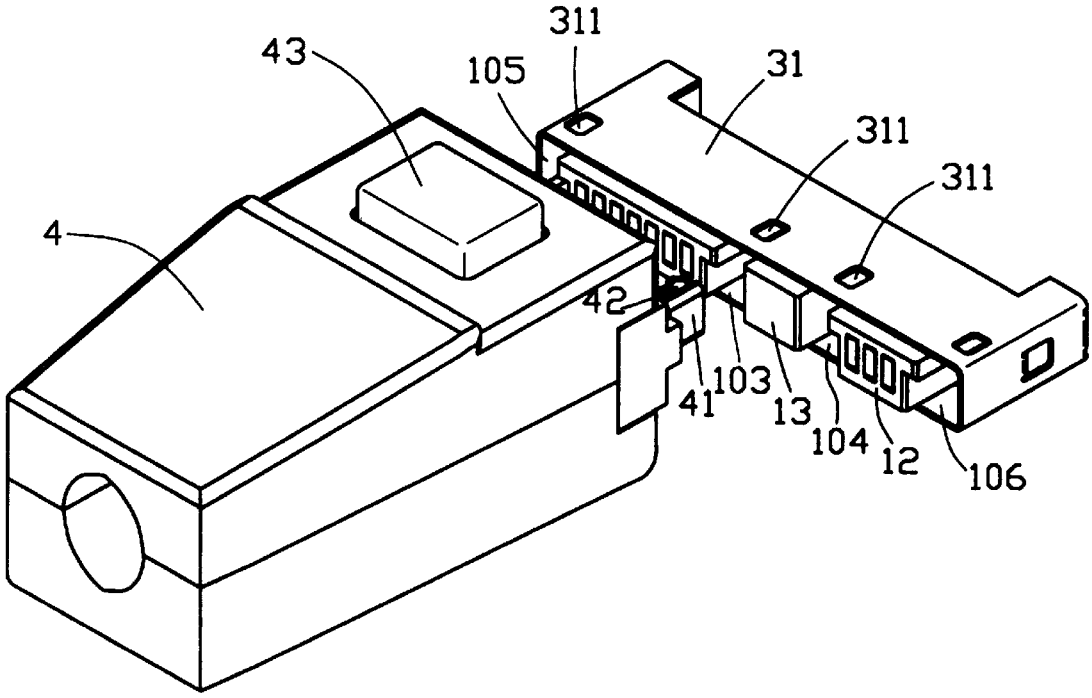
FIG. 6 is a perspective view of the assembled electrical connector of FIG. 1 and a first plug to be attached thereto.
Figure 7:
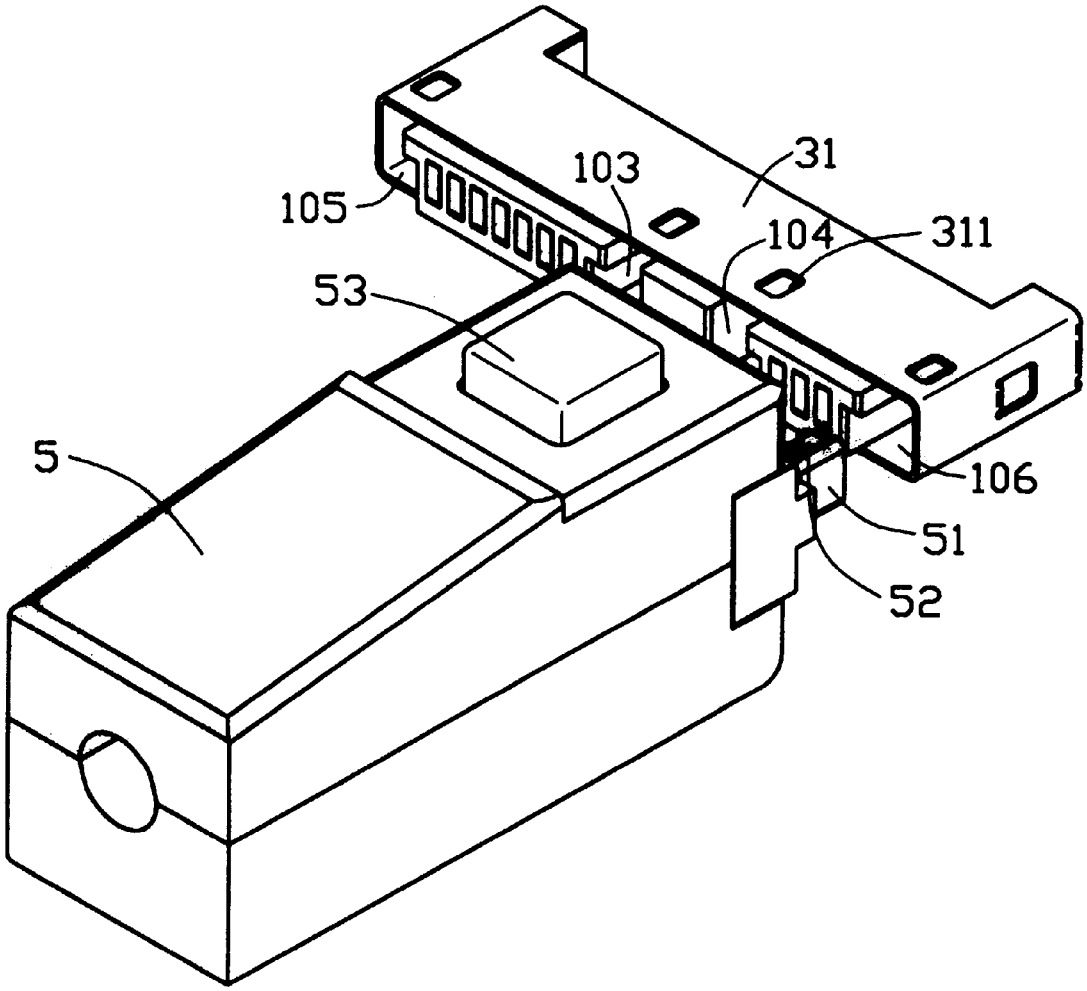
FIG. 7 is a perspective view of the assembled electrical connector of FIG. 1 and a second plug to be attached thereto.
Figure 8:
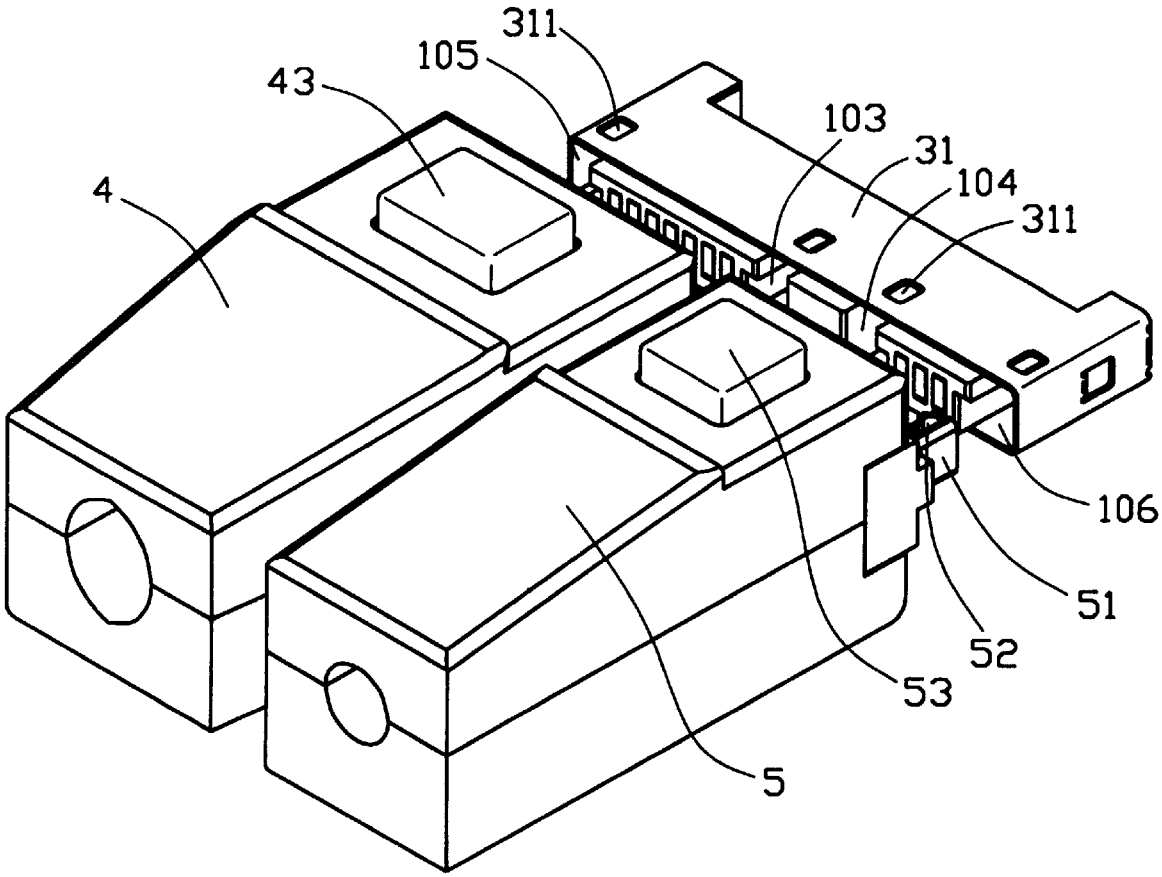
FIG. 8 is a perspective view of the assembled electrical connector of FIG. 1 and first and second plugs to be attached thereto.
Figure 9:
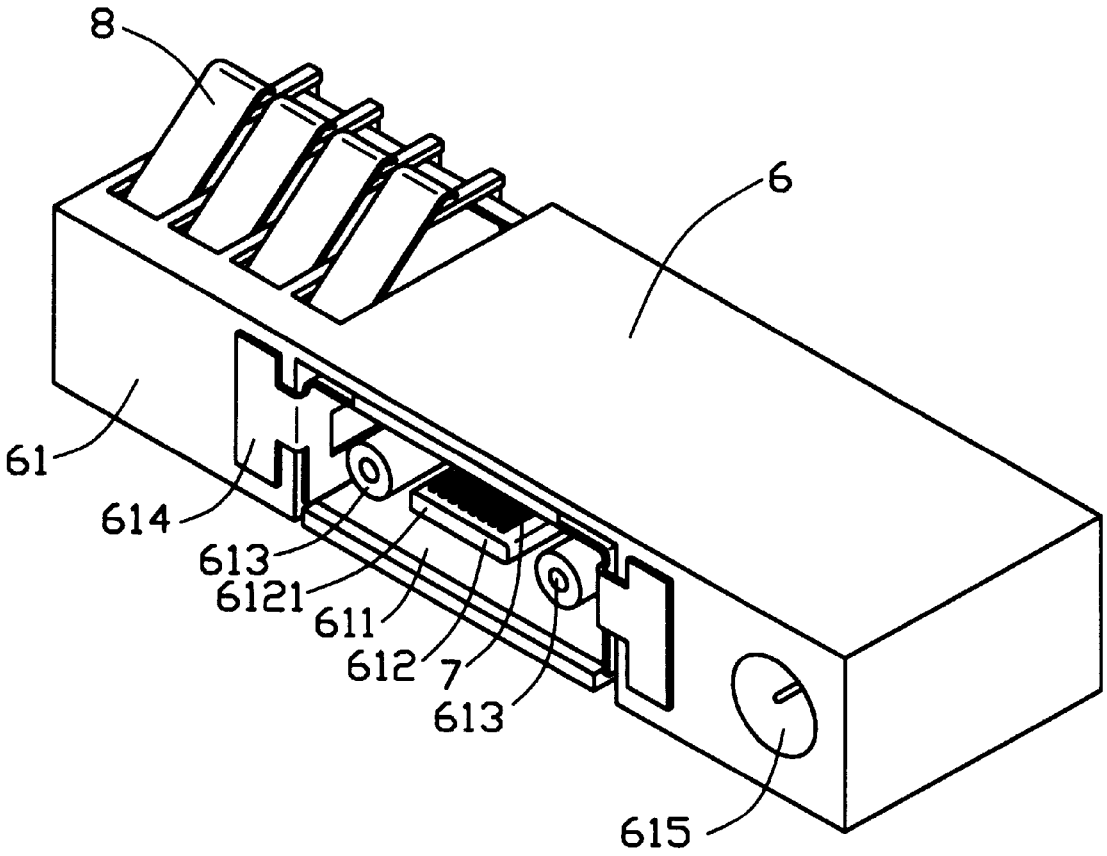
FIG. 9 (PRIOR ART)
FIG. 9 is a perspective view of an electrical connector of the prior art.

Referring to FIGS. 6–8, each of a signal plug connector 4 and a DC power recharger plug connector 5 is provided with a pair of guiding arms 41, 51 on a mating face (not labeled) thereof for inserting into corresponding positioning slots 103, 105; 104, 106. A locking barb 42, 52 is provide on a distal end of each guiding arm 41, 51. Each locking barb 42, 52 is moveably, controllably retractable into a corresponding guiding arm 41, 51. Retraction of a pair of locking barbs 42, 52 into a corresponding pair of guiding arms 41, 51 is controlled by a button 43, 53 of each plug connector 4, 5. When connecting the signal plug connector 4 with the first receptacle portion 11, the button 43 is pressed to cause the two locking barbs 42 to retract into the guiding arms 41, allowing the guiding arms 41 to be inserted into the correspond positioning slots 105, 103. The button 43 is then released to release the two locking barbs 42, allowing them to engage with the locking apertures 311, so that the signal plug connector 4 is firmly connected with the portable phone in which the electrical connector of the present invention is mounted. In a similar manner, the DC power plug connector 5 can be connected with the portable phone when needed. The signal plug connector 4 and the DC power plug recharger connector 5 can be connected with the portable phone at the same time, if needed, to facilitate use by the consumer.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing comprising a first receptacle portion, a second receptacle portion and a barrier separating the first receptacle portion from the second receptacle portion, each receptacle portion defining a plurality of contact receiving passageways therethrough, a respective first positioning slot being defined between each receptacle portion and the barrier;

a plurality of contacts received in the contact receiving passageways, each contact including an engaging section extending beyond a frontsurface of a corresponding receptacle portion, a transition section received in a corresponding contact receiving passageway, and a solder tail extending out of a rear surface of the corresponding receptacle portion for soldering to a printed circuit board; and a shield enclosing the housing and having a locking aperture on a top plate thereof above each positioning slot, a respective second positioning slot being defined between each receptacle portion and one of two side plates of the shield.

2. The electrical connector as claimed in claim 1, wherein a flange projects from an upper lateral side of each receptacle portion of the housing to assure correct insertion of a mating plug connector.

3. The electrical connector as claimed in claim 1, wherein the housing forms a pair of arms on two opposite sides, each arm having a front face forming a notch therein and a rear face, and wherein a side plate of the shell forms a locking tab for engaging with the notch and an integral retaining tab for abutting against the rear face.

4. An electrical connector comprising:

an insulative housing defining a first receptacle portion, a second receptacle portion and a barrier aligned with one another, said barrier intermediating between the first receptacle portion and the second receptacle portion;

a number of signal contacts disposed in the first receptacle portion, and a number of power contacts disposed in the second receptacle portion;

a shield enclosing the housing and abutting against opposite top and bottom surfaces of the housing while front portions of the first receptacle portion, the second receptacle portion and the barrier project beyond a front edge of the shield, wherein an engaging section of each of said contacts extends flush with a front face of a corresponding receptacle portion and is exposed to an exterior; and a first positioning slot formed between the first receptacle portion and the shield, a second positioning slot formed between the first receptacle portion and the barrier, a third positioning slot formed between the second receptacle portion and the barrier, and a fourth positioning slot formed between the second receptacle portion and the shield.

5. The connector as claimed in claim 4, wherein four locking apertures are formed in an upper portion of the shield in alignment with said first, second, third and fourth positioning slots, respectively.

* * * * *